US006024164A

United States Patent [19]

Sorbel

[11] Patent Number: 6,024,164

[45] Date of Patent: Feb. 15, 2000

[54] HEAT EXCHANGER ASSEMBLY

[75] Inventor: Dennis L. Sorbel, Maple Park, Ill.

[73] Assignee: Caterpillar Inc., Peoria, Ill.

[21] Appl. No.: 08/797,016

[22] Filed: Feb. 7, 1997

[51] Int. Cl.[7] ..... F28F 5/00

[52] U.S. Cl. ..... 165/41; 165/77; 165/78; 165/86; 165/140; 123/41.43; 180/68.4

[58] Field of Search ..... 165/41, 86, 78, 165/77, 149, 140, 67, 72, 73, 74; 123/41.43; 180/68.4

[56] References Cited

U.S. PATENT DOCUMENTS

| | | | |
|---|---|---|---|
| Re. 30,766 | 10/1981 | Bentz | 165/86 |
| 1,083,343 | 1/1914 | Sulzer . | |
| 1,882,912 | 10/1932 | Richardson | 165/77 X |
| 2,027,809 | 1/1936 | Cornell, Jr. | 257/184 |
| 2,078,000 | 4/1937 | Jensen | 165/77 X |
| 2,084,614 | 6/1937 | Goecke | 165/77 X |
| 2,256,882 | 9/1941 | Sebald | 257/239 |
| 2,300,663 | 11/1942 | Fette | 165/78 X |
| 3,000,193 | 9/1961 | Crider | 165/77 X |
| 3,285,327 | 11/1966 | Herrick | 165/77 X |
| 4,066,119 | 1/1978 | Stedman | 165/41 |
| 4,415,024 | 11/1983 | Baker | 165/160 |
| 4,542,785 | 9/1985 | Bagnall et al. | 165/41 X |
| 4,548,260 | 10/1985 | Stachura | 165/78 |
| 5,046,554 | 9/1991 | Iwasaki et al. | 165/140 |
| 5,107,688 | 4/1992 | Johnson | 165/77 X |
| 5,386,873 | 2/1995 | Harden, III et al. | 165/86 X |
| 5,725,047 | 3/1998 | Lopez | 165/149 |

FOREIGN PATENT DOCUMENTS

| | | | |
|---|---|---|---|
| 56-23645 | 3/1981 | Japan . | |
| 0214729 | 12/1983 | Japan | 165/78 |
| 484380 | 12/1975 | U.S.S.R. | 165/78 |
| 1500517 | 8/1989 | U.S.S.R. | 165/77 |

*Primary Examiner*—Ira S. Lazarus
*Assistant Examiner*—Christopher Atkinson
*Attorney, Agent, or Firm*—William B. Heming; Byron G. Buck

[57] ABSTRACT

A heat exchanger assembly includes a frame and a heat exchanger which is movable relative to the frame. The assembly further includes a handle pivotally secured to the frame. Moreover, the assembly includes a linkage pivotally secured to the handle. The linkage is also pivotally secured to the heat exchanger. Movement of the handle from a first handle position to a second handle position causes the heat exchanger to move from a first heat exchanger position to a second heat exchanger position.

16 Claims, 7 Drawing Sheets

HEAT EXCHANGER ASSEMBLY

BACKGROUND OF THE INVENTION

The present invention relates generally to a fluid cooling system of a work vehicles, and more particularly to a heat exchanger assembly of a fluid cooling system of a work vehicle.

Many work vehicles such as material handlers, excavators, wheel loaders, and bulldozers include fluid powered devices such as rams or cylinders. An operation fluid, such as oil, is pumped under pressure from a fluid pump to the fluid powered device wherein it is used to provide the motive power for operating the device. After use, the operation fluid is vented or otherwise exhausted from the fluid powered device and returned to a fluid storage tank.

The useful life of fluid powered devices is generally increased if the operation fluid is maintained at a cool temperature. Hence, prior to being returned to the fluid pump for subsequent use, the operation fluid is typically advanced through a heat exchanger thereby cooling the operation fluid prior to subsequent use.

The heat exchanger typically includes a number of coils through which the operation fluid is advanced. A number of fins or other members extend outwardly from the outside of the coils thereby functioning as a heatsink. As the heated operation fluid is advanced through the coils, heat is transferred from the operation fluid to the coils and the fins. Thereafter, air or a similar fluid, is blown across the coils and the fins thereby removing heat therefrom and cooling the operation fluid.

It is imperative for efficient heat transfer that the flow of air through the cooler is not obstructed. In particular, if the space between adjacent coils or fins becomes obstructed or otherwise blocked by debris, the flow of air is prohibited from reaching a number of the other coils or fins within the heat exchanger. Hence, heat is not effectively removed from the coils and the fins thereby reducing the effectiveness of the coils and the fins to function as a heatsink. Therefore, the heat exchanger must be occasionally cleaned. In particular, the heat exchanger is removed from the work vehicle and a pressurized stream of air or water is blown across the coils and the fins in order to remove the debris therefrom.

Removal of the heat exchanger from the vehicle is often a difficult process. In particular, the heat exchanger is commonly sandwiched between other components such as an engine radiator and an engine air cooler thereby making the heat exchanger relatively difficult to access. Moreover, when the heat exchanger is full of spent operation fluid, it can weigh as much as a several hundred pounds. In addition, the heat exchanger may operate at temperatures in excess of 180° Fahrenheit. Hence, it may take a relatively large amount of time since the operator must drain the heat exchanger and then allow the heat exchanger to cool to an acceptable temperature prior to removing it from the vehicle.

What is needed therefore is a heat exchanger assembly which allows the operator to move the heat exchanger when the heat exchanger is full of operation fluid. What is further needed is a heat exchanger assembly which allows the operator to move the heat exchanger when the heat exchanger is relatively hot.

SUMMARY OF THE INVENTION

In accordance with one embodiment of the present invention, there is provided a heat exchanger assembly. The assembly includes a frame and a heat exchanger which is movable relative to the frame. The assembly further includes a handle pivotally secured to the frame. Moreover, the assembly includes a linkage pivotally secured to the handle. The linkage is also pivotally secured to the heat exchanger. Movement of the handle from a first handle position to a second handle position causes the heat exchanger to move from a first heat exchanger position to a second heat exchanger position.

In accordance with a second embodiment of the present invention, there is provided a heat exchanger assembly. The assembly includes a frame and a heat exchanger which is movable relative to the frame. The assembly further includes a handle pivotally secured to the frame. Moreover, the assembly includes an upper linkage pivotally secured to the handle. The upper linkage is also pivotally secured to the heat exchanger. The assembly also includes a first lower linkage pivotally secured to the frame and a second lower linkage pivotally secured to the heat exchanger. The second lower linkage is also pivotally secured to the first lower linkage. Movement of the handle from a first handle position to a second handle position causes the heat exchanger to move from a first heat exchanger position to a second heat exchanger position.

In accordance with a third embodiment of the present invention, there is provided a heat exchanger assembly. The assembly includes a frame and a heat exchanger which is movable relative to the frame. The assembly further includes a left handle pivotally secured to the frame, and a right handle pivotally secured to the frame. Moreover, the assembly includes a left linkage pivotally secured to the left handle. The left linkage is also pivotally secured to the heat exchanger. The assembly also includes a right linkage pivotally secured to the right handle. The right linkage is also pivotally secured to the heat exchanger. Movement of the right handle from a first right handle position to a second right handle position causes the heat exchanger to move from a first heat exchanger position to a second heat exchanger position. Additionally, movement of the left handle from a first left handle position to a second left handle position causes the heat exchanger to move from the first heat exchanger position to the second heat exchanger position.

It is therefore an object of the present invention to provide a new and useful heat exchanger assembly.

It is another object of the present invention to provide an improved heat exchanger assembly.

It is yet another object of the present invention to provide a heat exchanger assembly which allows a heat exchanger to be easily moved relative adjacent machine components.

It is moreover an object of the present invention to provide a heat exchanger assembly which may be easily accessed for cleaning.

The above and other objects, features, and advantages of the present invention will become apparent from the following description and the attached drawings.

DETAILED DESCRIPTION OF THE PREFERRED EMBODIMENT

Figure 1:
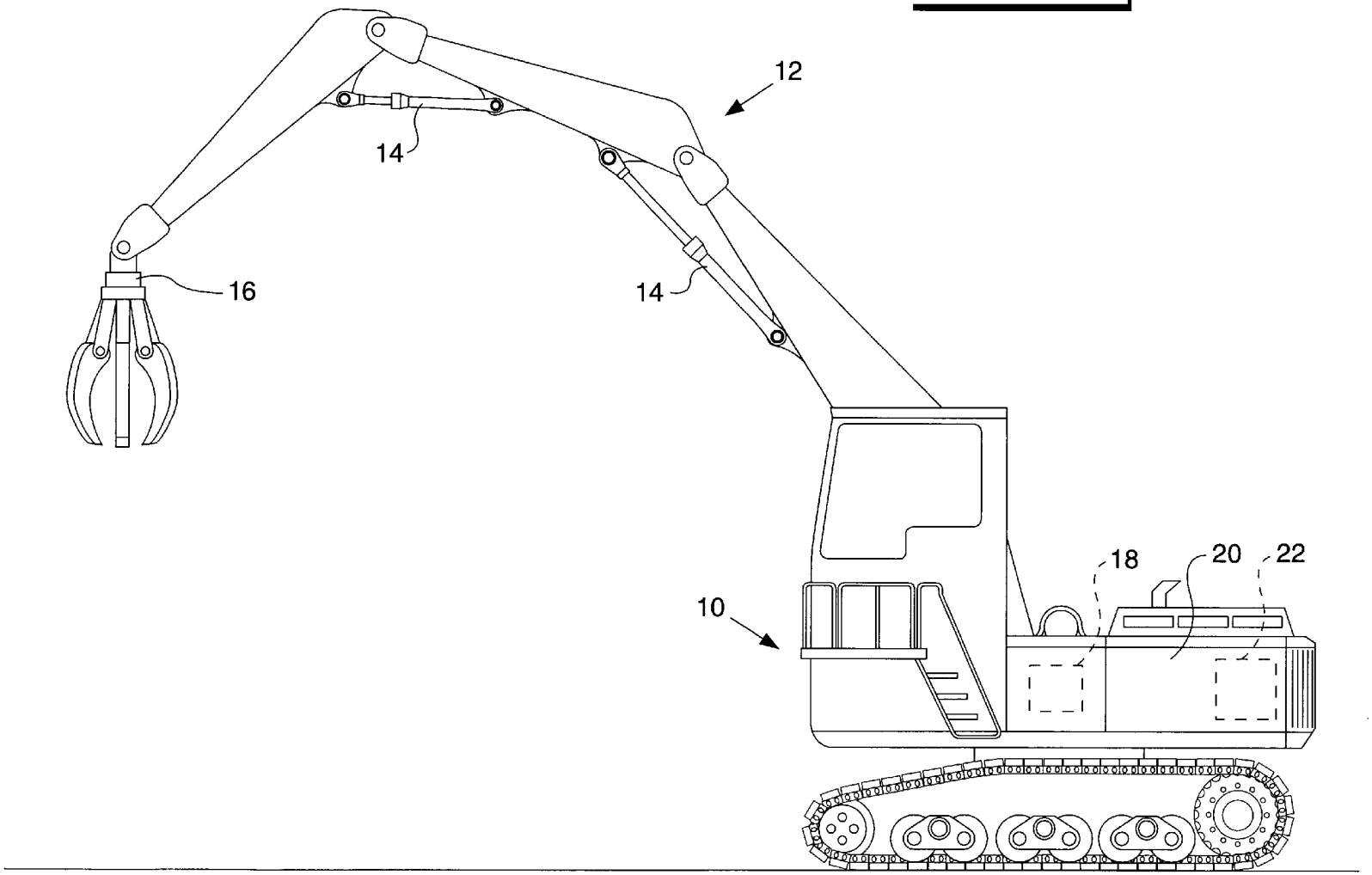
FIG. 1 is a is a side elevational view of a work vehicle which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a work vehicle or material handler 10. The material handler 10 includes a boom assembly 12, a number of fluid cylinders 14, and a grapple 16.

The fluid cylinders 14 are in fluid communication with a fluid pump 18 which provides the operation fluid pressure for extending and retracting the fluid cylinders 14 thereby providing the motive power for moving the boom linkage 12. Likewise, the grapple 16 includes a number of fluid rams (not shown) which are in fluid communication with the fluid pump 18 thereby providing the motive power for operating the grapple 16.

Disposed behind an access door 20, the material handler 10 further includes a heat exchanger assembly 22. The heat exchanger assembly 22 includes a heat exchanger 24 (see FIG. 2) which is in fluid communication with the fluid cylinders 14, the fluid rams of the grapple 16, and the fluid pump 18. Exhausted or spent operation fluid from the fluid cylinders 14 and the fluid rams of the grapple 16 is advanced to the heat exchanger 24 wherein the spent operation fluid is cooled prior to advancement to a fluid reservoir (not shown) and thereafter the fluid pump 18 for subsequent use thereof. Hence, it should be appreciated that the heat exchanger 24 functions as an operation or hydraulic fluid cooler.

Figure 2:
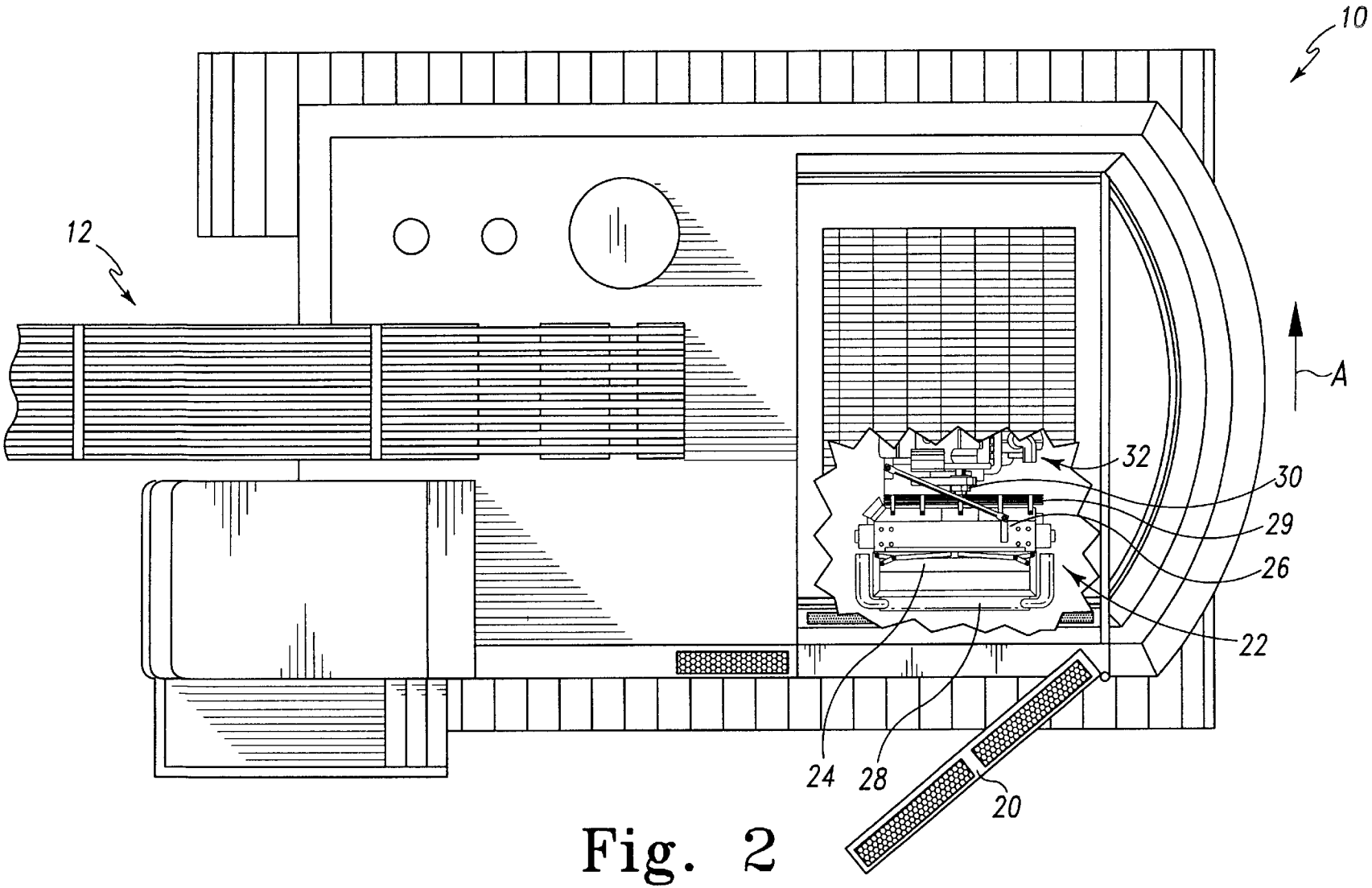
FIG. 2 is a fragmentary top elevational view of the work vehicle of FIG. 1.

Referring now to FIG. 2, there is shown the material handler 10 in more detail. Note that the access door 20 is in an open position thereby allowing an operator of the material handler 10 to access the heat exchanger assembly 22.

The heat exchanger assembly 22 includes the heat exchanger 24, a radiator 26, and an engine air cooler 28. The heat exchanger assembly 22 is bolted or otherwise coupled to a chassis (not shown) thereby securing the heat exchanger assembly 22 to the material handler 10.

A fan unit 29 is coupled to an output shaft 30 of an engine 32. Rotation of the output shaft 30 causes the fan unit 29 to be likewise rotated thereby creating a flow of air in the general direction of arrow A in FIG. 2. The flow of air is advanced across the engine air cooler 28, the heat exchanger 24, and the radiator 26.

The engine air cooler 28 functions as an air exchanger for a turbo unit (not shown) associated with the engine 32. The flow of air generated by the fan unit 29 is advanced into the engine air cooler 28 thereby creating a flow of air for use by the turbo unit.

The spent operation fluid from the fluid cylinders 14 and the fluid rams of the grapple 16 is advanced through a number of coils (not shown) included in the heat exchanger 24. The coils have a number of fins 23 (see FIG. 5) extending outwardly therefrom. Heat from the spent operation fluid is transferred to the coils and the fins 23 as the spent operation fluid advances through the coils. The flow of air generated by the fan unit 29 which exits from the engine air cooler 28 is advanced across the coils and the fins 23 thereby removing heat from the coils and the fins 23. Thereafter, the flow of air is advanced to the radiator 26. Hence, the operation fluid is cooled prior to being advanced back to the fluid reservoir (not shown) and thereafter the fluid pump 18 (see FIG. 1) for subsequent use thereof by the fluid cylinders 14 and the fluid rams of the grapple 16 (see FIG. 1).

Similarly, an exhausted or spent engine cooling fluid is advanced through the radiator 26. As the spent engine cooling fluid is advanced through the radiator, heat therein is transferred to a number coils (not shown) included in the radiator 26. Thereafter, the flow of air generated by the fan unit 29 which exits the engine air cooler 28 and the heat exchanger 24 is advanced across the coils of the radiator 26 thereby removing heat from the coils. Hence, the engine cooling fluid is cooled prior to subsequent use thereof by the engine 32.

Figure 3:
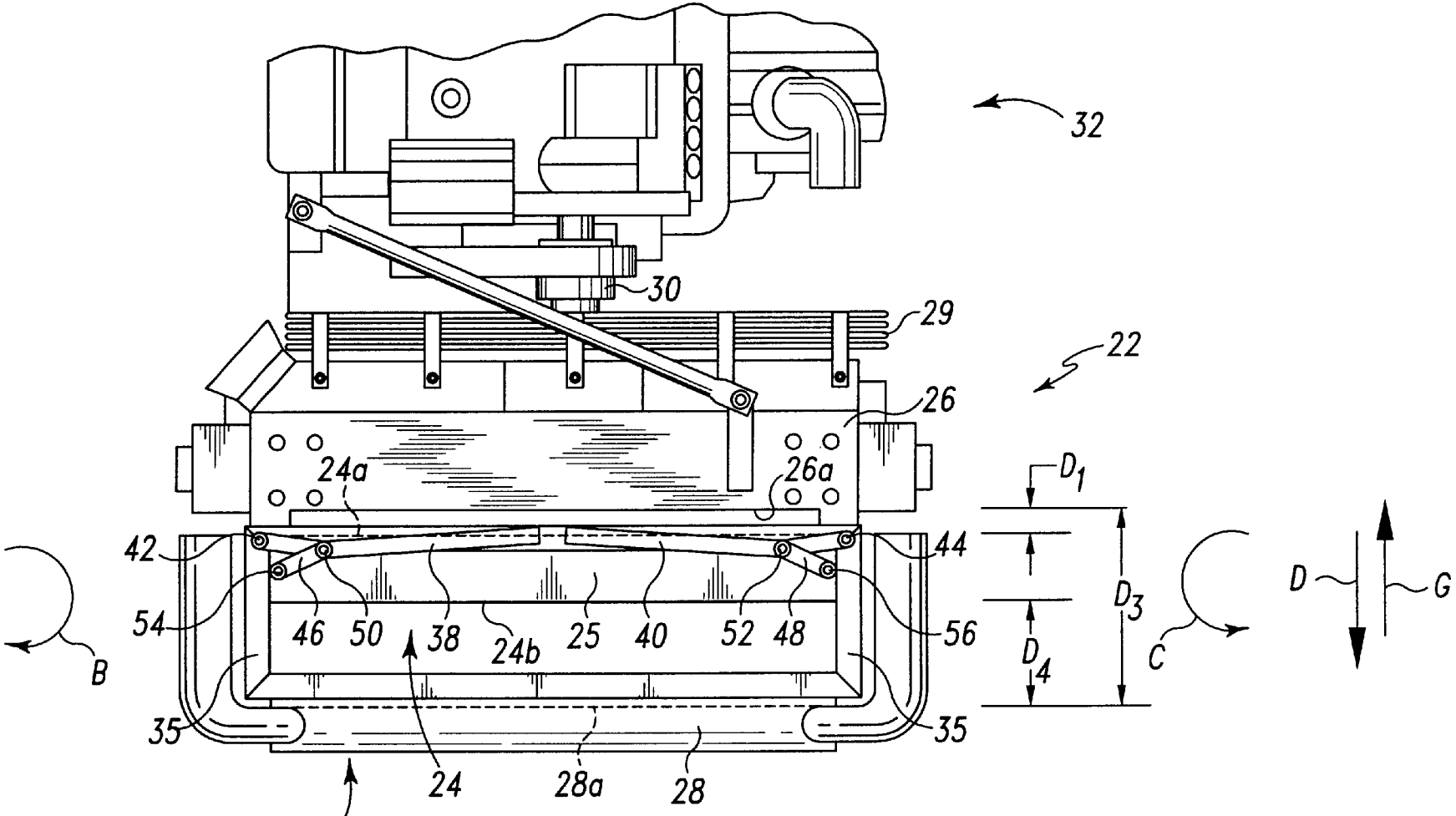
FIG. 3 is an enlarged fragmentary top elevational view of the work vehicle of FIG. 1 showing the relationship between the heat exchanger assembly, the fan, and the engine with the heat exchanger of the heat exchanger assembly shown in a first heat exchanger position.

Referring now to FIGS. 3–7, there is shown the heat exchanger assembly 22 in more detail. In particular, the heat exchanger 24 is movably supported within a frame 36. Pivotally secured to a top section 35 of the frame 36 is a left handle 38 and a right handle 40. More specifically, the frame 36 includes a pair of elongated support members 43 and 45 (see FIG. 5) to which a respective first end thereof is coupled to the left handle 38 and the right handle 40 via a pair of pin joints 42 and 44, respectively, as shown in FIG. 3.

At a respective first end, a left upper linkage 46 and a right upper linkage 48 are pivotally coupled to the left handle 38 and the right handle 40, respectively. More specifically, the left upper linkage 46 and the right upper linkage 48 are respectively coupled to the left handle 38 and the right handle 40 via a pair of pin joints 50 and 52 as shown in FIG. 3.

At a respective second end, the left upper linkage 46 and the right upper linkage 48 are pivotally coupled to a top surface 25 of the heat exchanger 24. More specifically, the left upper linkage 46 and the right upper linkage 48 are respectively coupled to the top surface 25 via a pair of pin joints 54 and 56 as shown in FIG. 3.

Figure 5:
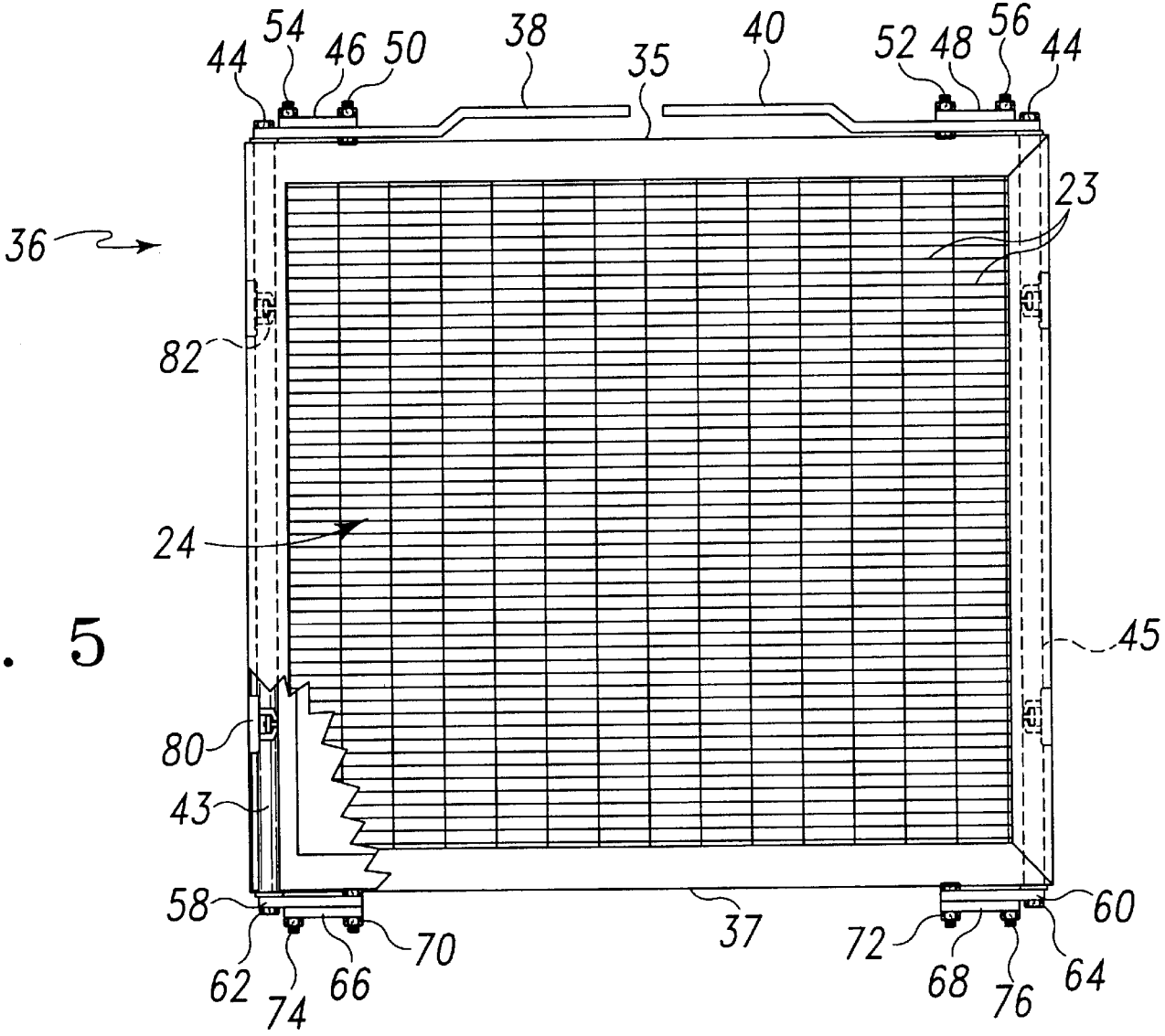
FIG. 5 is a side elevational view of the heat exchanger assembly of FIG. 3.
Figure 7:
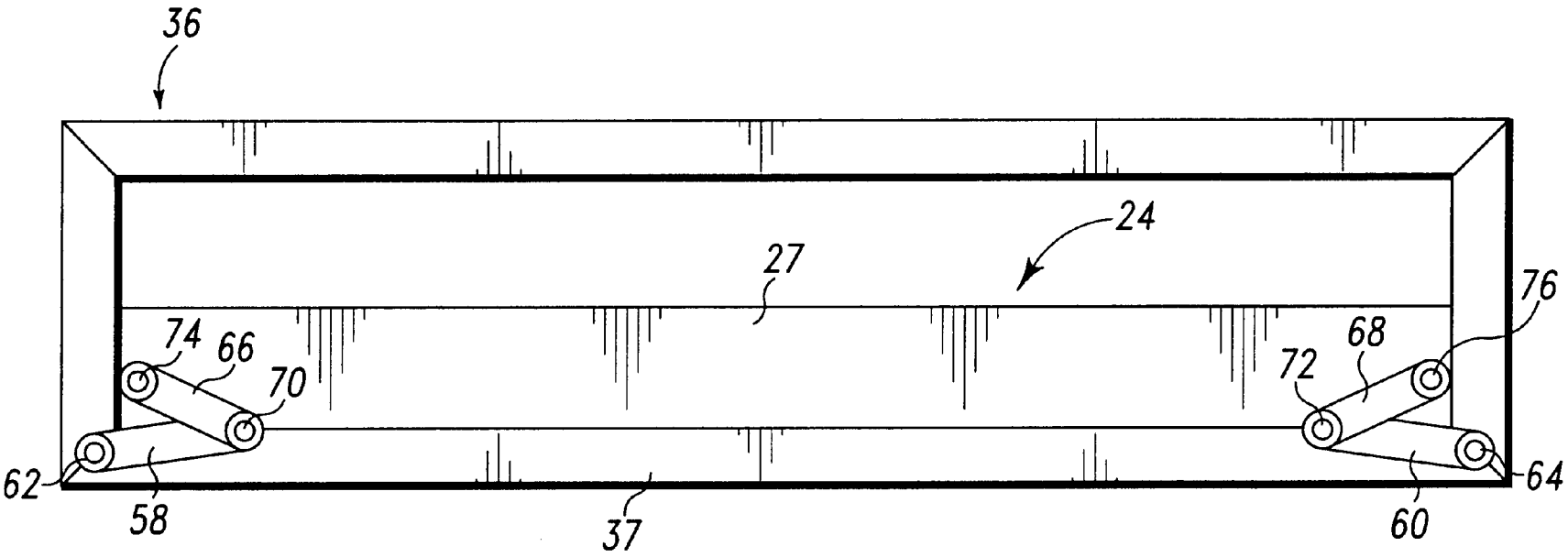
FIG. 7 is a bottom elevational view of the heat exchanger assembly of FIG. 5.

Pivotally secured to a bottom surface 37 of the frame 36 is a first left lower linkage 58 and a first right lower linkage 60 as shown in FIG. 7. More specifically, the first left lower linkage 58 and the first right lower linkage 60 are respectively coupled to a second end of the support members 43 and 45 via a pair of pin joints 62 and 64 as shown in FIG. 5.

At a respective first end, a second left lower linkage 66 and a second right lower linkage 68 are pivotally coupled to the first left lower linkage 58 and the first right lower linkage 60, respectively. More specifically, the second left lower linkage 66 and the second right lower linkage 68 are respectively coupled to the first left lower linkage 58 and the first right lower linkage 60 via a pair of pin joints 70 and 72 as shown in FIG. 7.

At a respective second end, the second left lower linkage 66 and the second right lower linkage 68 are pivotally coupled to a bottom surface 27 of the heat exchanger 24. More specifically, the second left lower linkage 66 and the second right lower linkage 68 are respectively coupled to the bottom surface 27 via a pair of pin joints 74 and 76 as shown in FIG. 7.

Figure 6:
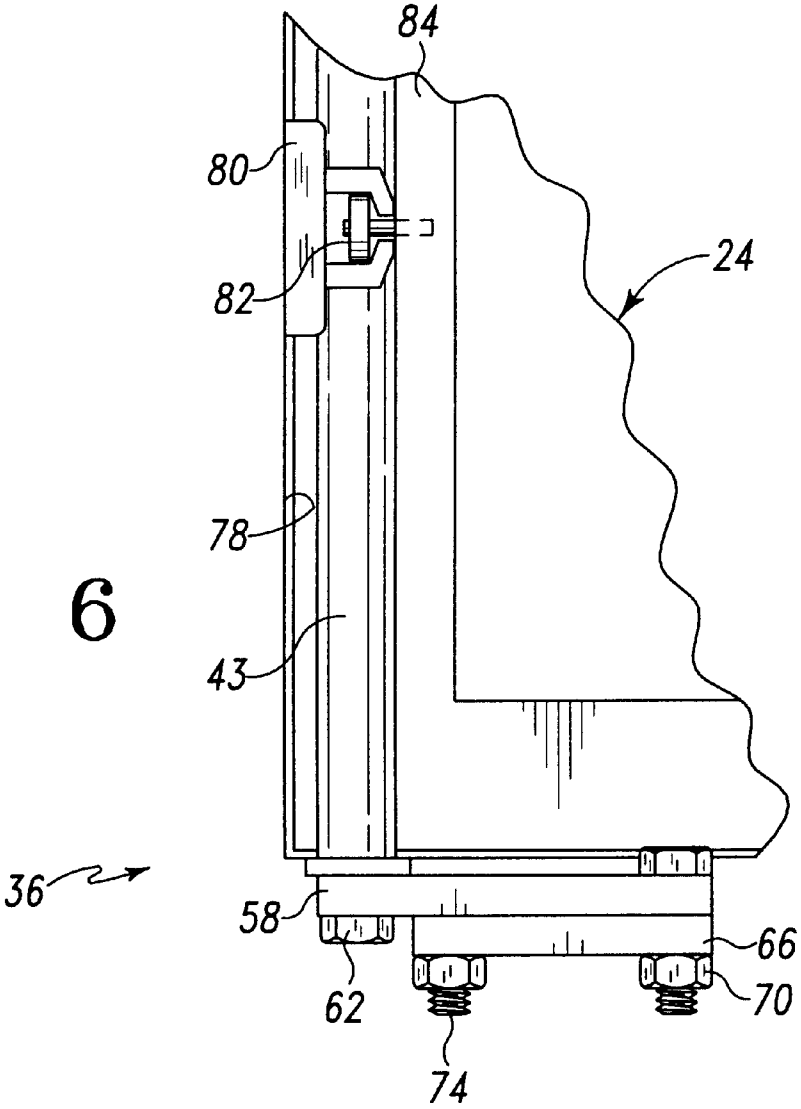
FIG. 6 is an enlarged fragmentary view of the heat exchanger assembly of FIG. 5.

Secured to an inner side surface 78 of the frame 36 is a number of first rail members or elongated tracks 80 as shown in FIG. 6. Similarly, a number of second rail members or rollers 82 are secured to an outer side surface 84 of the heat exchanger 24. The rollers 82 are received into the elongated tracks 80 and cooperate therewith to facilitate movement of the heat exchanger 24 relative the frame 36.

Figure 4:
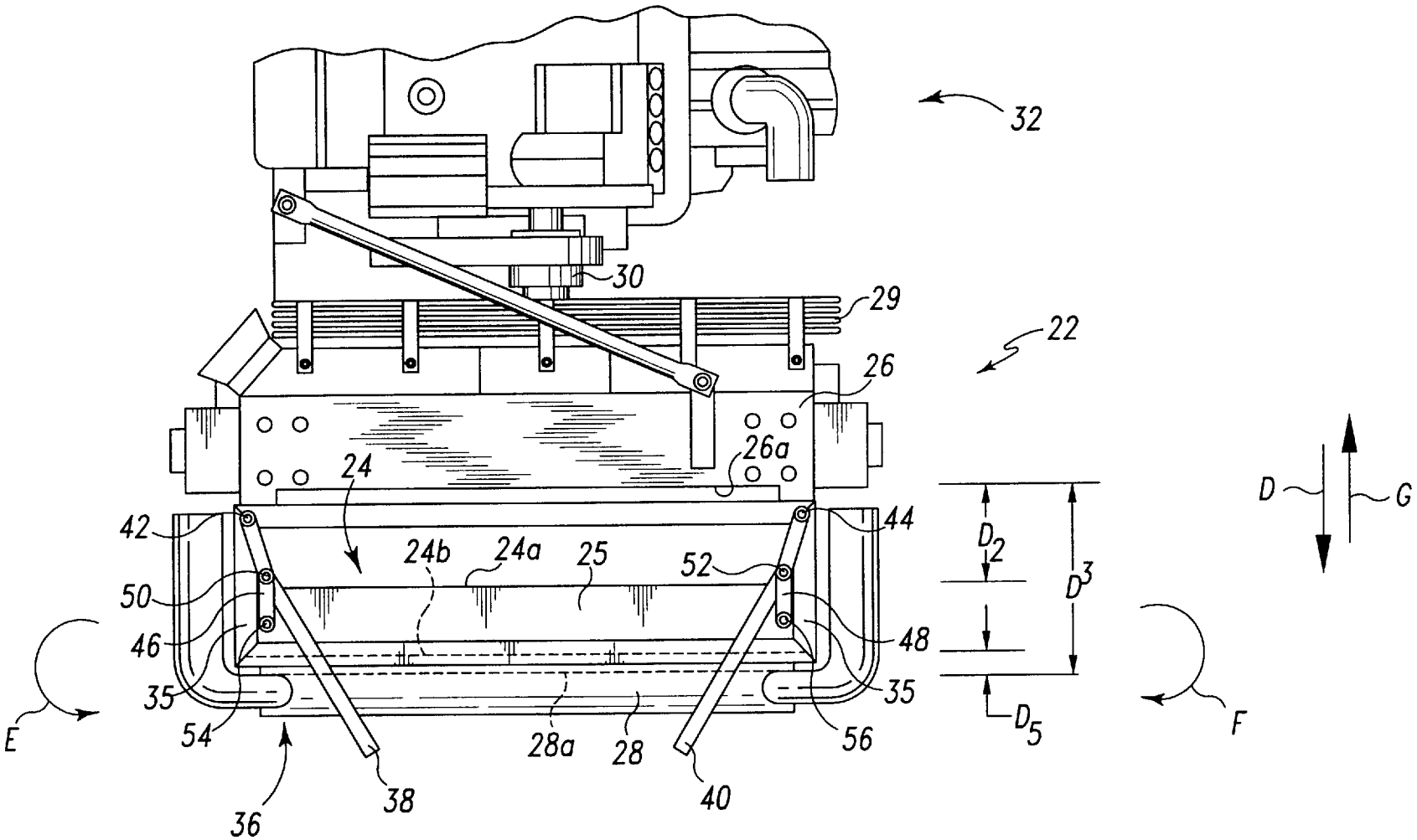
FIG. 4 is a view similar to FIG. 3, but showing the heat exchanger of the heat exchanger assembly in a second heat exchanger position.

In operation, the heat exchanger 24 is positioned in a first heat exchanger position when the left handle 38 and the right handle 40 are respectively positioned in a first left handle position and a first right handle position as shown in FIG. 3. However, if an operator of the material handler 10 moves the left handle 38 and the right handle 40 in the respective general directions of arrows B and C of FIG. 3, the left handle 38 will be placed in a second left handle position and the right handle 40 will be placed in a second right handle position thereby urging the heat exchanger 24 in the general direction of arrow D and into a second heat exchanger position as shown in FIG. 4. In order to return the heat exchanger 24 to the first heat exchanger position, the left handle 38 and the right handle 40 are moved in the respective general directions of arrows E and F of FIG. 4 thereby urging the heat exchanger 24 in the general direction of arrow G and back into the first heat exchanger position.

When the heat exchanger 24 is positioned in the first heat exchanger position, an air inlet surface 24*a* of the heat exchanger 24 is spaced apart from an air outlet surface 26*a* of the radiator 26 by a distance of $D_1$ as shown in FIG. 3. However, when the heat exchanger 24 is positioned in the second heat exchanger position, the air inlet surface 24*a* of the heat exchanger 24 is spaced apart from the air outlet surface 26*a* of the radiator 26 by a distance of $D_2$ as shown in FIG. 4. It should be appreciated that the distance $D_2$ is greater in magnitude than the distance $D_1$.

Similarly, when the heat exchanger 24 is positioned in the first heat exchanger position an air outlet surface 24*b* of the heat exchanger 24 is spaced apart from an air inlet surface 28*a* of the engine air cooler 28 by a distance $D_4$ as shown in FIG. 3.

However, when the heat exchanger 24 is positioned in the second heat exchanger position, the air outlet surface 24*b* of the heat exchanger 24 is spaced apart from the air inlet surface 28*a* of the engine air cooler 28 by a distance $D_5$ as shown in FIG. 4. It should be appreciated that the distance $D_4$ is greater in magnitude than the distance $D_5$.

The air outlet surface 26*a* of the radiator 26 is spaced apart from the air inlet surface 28*a* of the engine air cooler 28 by a distance of $D_3$. The radiator 26 and the engine air cooler 28 do not move relative one another. Hence, the distance $D_3$ is fixed in magnitude. It should therefore be appreciated that the distance $D_3$ is greater in magnitude than each of the distances $D_1$, $D_2$, $D_4$, and $D_5$.

As described above, the heat exchanger 24 may be selectively moved from the first heat exchanger position to the second heat exchanger position thereby permitting an operator of the material handler 10 to clean or otherwise service the heat exchanger assembly 22. In particular, when the heat exchanger 24 is in the first heat exchanger position, the operator may easily access the air outlet surface 24*b* of the heat exchanger 24 and the air inlet surface 28*a* of the engine air cooler 28 with an air wand (not shown) or the like in order to blow or otherwise remove debris from the heat transfer surfaces thereof (e.g. the fins 23). Similarly, when the heat exchanger 24 is in the second heat exchanger position, the operator may easily access the air outlet surface 26*a* of the radiator 26 and the air inlet surface 24*a* of the heat exchanger 24 with the air wand in order to remove debris from the heat transfer surfaces thereof (e.g. the radiator coils or the fins 23).

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A heat exchanger assembly, comprising:

a frame;

a heat exchanger which is movable between first and second positions relative to said frame;

a handle pivotally secured to said frame and movable between first and second handle positions;

a first rail member secured to said frame;

a second rail member secured to said heat exchanger, wherein said first rail member movably engages said second rail member so as to facilitate relative movement between said frame and said heat exchanger; and a linkage pivotally secured to said handle, said linkage further being pivotally secured to said heat exchanger, wherein movement of said handle from the first handle position to the second handle position causes said heat exchanger to move from the first heat exchanger position to the second heat exchanger position.

2. The assembly of claim 1, wherein:

said linkage has a first end and a second end, said first end of said linkage is coupled to said handle, and said second end of said linkage is coupled to said heat exchanger.

3. The assembly of claim 1, wherein:

said first rail member defines an elongated track, and said second rail member includes a roller which contacts said elongated track.

4. The assembly of claim 1, wherein:

said heat exchanger is a hydraulic fluid cooler unit.

5. The assembly of claim 1, further comprising a radiator which is fixed in relation to said frame, wherein:

said heat exchanger is spaced apart from said radiator by a first distance when said heat exchanger is positioned at said first heat exchanger position, said heat exchanger is spaced apart from said radiator by a second distance when said heat exchanger is position at said second heat exchanger position, and said first distance is less than said second distance.

6. The assembly of claim 5, further comprising an engine air cooler which is fixed in relation to said frame, wherein:

said engine air cooler is spaced apart from said radiator by a third distance, said heat exchanger is spaced apart from said engine air cooler by a fourth distance when said heat exchanger is positioned at said first heat exchanger position, said heat exchanger is spaced apart from said engine air cooler by a fifth distance when said heat exchanger is position at said second heat exchanger position, and said fourth distance is greater than said fifth distance.

7. The assembly of claim 6, wherein:

said heat exchanger is interposed between said radiator and said engine air cooler, and said third distance is greater than each of said first distance, said second distance, said fourth distance, and said fifth distance.

8. A heat exchanger assembly, comprising:

a frame;

a heat exchanger which is movable relative to said frame;

a handle pivotally secured to said frame;

an upper linkage pivotally secured to said handle, said upper linkage further being pivotally secured to said heat exchanger, a first lower linkage pivotally secured to said frame;

a second lower linkage pivotally secured to said heat exchanger, said second lower linkage further being pivotally secured to said first lower linkage;

wherein movement of said handle from a first handle position to a second handle position causes said heat exchanger to move from a first heat exchanger position to a second heat exchanger position.

9. The assembly of claim 8, further comprising an elongated support member secured to said frame, wherein:

said elongated support member has a first end and a second end, said first end of said elongated support member is pivotally secured to said handle, and said second end of said elongated support member is pivotally secured to said first lower linkage.

10. A heat exchanger assembly, comprising:

a frame;

a heat exchanger which is movable relative to said frame;

a left handle pivotally secured to said frame;

a right handle pivotally secured to said frame;

a left linkage pivotally secured to said left handle, said left linkage further being pivotally secured to said heat exchanger; and a right linkage pivotally secured to said right handle, said right linkage further being pivotally secured to said heat exchanger, wherein movement of said right handle from a first right handle position to a second right handle position causes said heat exchanger to move from a first heat exchanger position to a second heat exchanger position, and wherein movement of said left handle from a first left handle position to a second left handle position causes said heat exchanger to move from the first heat exchanger position to the second heat exchanger position.

11. The assembly of claim 10, wherein:

said left linkage has a first end and a second end, said right linkage has a third end and a fourth end, said first end of said left linkage is coupled to said left handle, said third end of said right linkage is coupled to said right handle, said second end of said left linkage is coupled to said heat exchanger, and said fourth end of said right linkage is coupled to said heat exchanger.

12. The assembly of claim 10, further comprising:

a first rail member secured to said frame; and a second rail member secured to said heat exchanger, wherein said first rail member movably engages said second rail member so as to facilitate relative movement therebetween.

13. The assembly of claim 12, wherein:

said first rail member defines an elongated track, and said second rail member includes a roller which contacts said elongated track.

14. The assembly of claim 10, further comprising a radiator which is fixed in relation to said frame, wherein:

said heat exchanger is spaced apart from said radiator by a first distance when said heat exchanger is positioned at said first heat exchanger position, said heat exchanger is spaced apart from said radiator by a second distance when said heat exchanger is position at said second heat exchanger position, and said first distance is less than said second distance.

15. The assembly of claim 14, further comprising an engine air cooler which is fixed in relation to said frame, wherein:

said engine air cooler is spaced apart from said radiator by a third distance, said heat exchanger is spaced apart from said engine air cooler by a fourth distance when said heat exchanger is positioned at said first heat exchanger position, said heat exchanger is spaced apart from said engine air cooler by a fifth distance when said heat exchanger is position at said second heat exchanger position, and said fourth distance is greater than said fifth distance.

16. The assembly of claim 15, wherein:

said heat exchanger is interposed between said radiator and said engine air cooler, and said third distance is greater than each of said first distance, said second distance, said fourth distance, and said fifth distance.

* * * * *